US009404357B2

(12) United States Patent
Martinez et al.

(10) Patent No.: US 9,404,357 B2
(45) Date of Patent: Aug. 2, 2016

(54) SHOCK TOLERANT HEAT DISSIPATING ELECTRONICS PACKAGE

(75) Inventors: Ruben Martinez, Houston, TX (US); Adan Diaz, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 726 days.

(21) Appl. No.: 13/518,898

(22) PCT Filed: Dec. 22, 2010

(86) PCT No.: PCT/US2010/061727

§ 371 (c)(1), (2), (4) Date: Oct. 1, 2012

(87) PCT Pub. No.: WO2011/079171

PCT Pub. Date: Jun. 30, 2011

(65) Prior Publication Data

US 2013/0025886 A1 Jan. 31, 2013

Related U.S. Application Data

(60) Provisional application No. 61/290,045, filed on Dec. 24, 2009.

(51) Int. Cl.
*E21B 47/01* (2012.01)

(52) U.S. Cl.
CPC ..... *E21B 47/011* (2013.01); *Y10T 29/49938* (2015.01)

(58) Field of Classification Search
CPC ..... E21B 47/01; E21B 47/011; E21B 33/12; E21B 33/129; E21B 23/01; E21B 23/04
See application file for complete search history.

(56) References Cited

U.S. PATENT DOCUMENTS

| | | | | |
|---|---|---|---|---|
| 3,735,206 | A * | 5/1973 | Pesek | 361/721 |
| 4,354,770 | A | 10/1982 | Block | |
| 4,400,858 | A | 8/1983 | Goiffon et al. | |
| 4,547,833 | A | 10/1985 | Sharp | |
| 4,891,734 | A | 1/1990 | More et al. | |
| 5,398,753 | A | 3/1995 | Obrejanu et al. | |
| 5,675,120 | A | 10/1997 | Craft et al. | |
| 6,112,809 | A | 9/2000 | Angle | |

(Continued)

FOREIGN PATENT DOCUMENTS

| | | |
|---|---|---|
| CN | 2325576 Y | 6/1999 |
| WO | 2007123417 A1 | 11/2007 |

(Continued)

OTHER PUBLICATIONS

International Search Report & Written Opinion issued in PCT/US2010/061727 on Jul. 5, 2012; 8 pages.

(Continued)

*Primary Examiner* — Kenneth L Thompson
*Assistant Examiner* — Steven MacDonald

(57) ABSTRACT

An electronics package of substantially monolithic configuration. The package is particularly adept at enhancing heat dissipation and avoiding secondary shock when placed in harsh application environments. Thus, the package may be particularly well suited for use in conjunction with high shock producing downhole application environments such as bridge plug setting.

14 Claims, 6 Drawing Sheets

(56) References Cited

U.S. PATENT DOCUMENTS

| | | | | |
|---|---|---|---|---|
| 7,051,810 | B2 | 5/2006 | Clemens et al. | |
| 7,284,613 | B2 | 10/2007 | Billingham et al. | |
| 7,458,423 | B2 | 12/2008 | Vercaemer et al. | |
| 7,540,327 | B2 | 6/2009 | Billingham | |
| 7,559,361 | B2 | 7/2009 | Obrejanu | |
| 7,661,477 | B2 | 2/2010 | Sheiretov et al. | |
| 7,886,834 | B2 | 2/2011 | Spencer et al. | |
| 7,997,313 | B2 * | 8/2011 | Wang | 144/286.1 |
| 8,028,752 | B2 | 10/2011 | Richards | |
| 8,286,716 | B2 | 10/2012 | Martinez et al. | |
| 2008/0190605 | A1 * | 8/2008 | Clapp et al. | 166/250.17 |
| 2011/0272145 | A1 * | 11/2011 | Crawford et al. | 166/250.01 |

FOREIGN PATENT DOCUMENTS

| | | | |
|---|---|---|---|
| WO | 2008111844 | A1 | 9/2008 |
| WO | 2009085732 | A2 | 7/2009 |
| WO | 2009085732 | A3 | 9/2009 |

OTHER PUBLICATIONS

Office Action issued in MX/A/2012/007525 on Mar. 17, 2015, 9 pages.

Notification of First Office Action and Search Report for Chinese Application No. 201080059961.X dated May 4, 2014.

Notification of Second Office Action for Chinese Application No. 201080059961.X dated Feb. 9, 2015.

Examination Report for GCC Application No. GC 2010-17477 dated Dec. 9, 2013.

Notification of Allowance for Chinese Application No. 201080059961.X dated Oct. 13, 2015, 3 pgs.

Second Office Action for Mexican Application No. MX/a/2012/007525 dated Oct. 7, 2015, 2 pgs.

International Preliminary Report on Patentability for PCT No. PCT/US2010/061727 dated Oct. 8, 2015.

* cited by examiner

SHOCK TOLERANT HEAT DISSIPATING ELECTRONICS PACKAGE

FIELD

Embodiments described relate to electronics packaging. In particular, packaging that is to be exposed to significant amounts of heat and shock. More specifically, packaging that is employed in a high temperature downhole environment and subject to several hundred g's of shock is detailed herein.

BACKGROUND

Exploring, drilling and completing hydrocarbon and other wells are generally complicated, time consuming, and ultimately very expensive endeavors. As a result, over the years, a significant amount of added emphasis has been placed on overall well architecture, monitoring and follow on interventional maintenance. Indeed, perhaps even more emphasis has been directed at minimizing costs associated with applications in furtherance of well formation, monitoring and maintenance. All in all, careful attention to the cost effective and reliable execution of such applications may help maximize production and extend well life. Thus, a substantial return on the investment in the completed well may be better ensured.

Depending on the nature and architecture of the well, interventional maintenance may be a routine part of operations. For example, proper well management may require the periodic clean-out of debris or scale from certain downhole locations. This may require isolating the location at issue and halting production during the clean out. Indeed, such isolating may be required in the natural course of completions, for example, to allow for perforating and/or stimulating applications to proceed. That is, in certain instances, high pressure perforating and stimulating of well regions may be called for. In this case, the active perforating or stimulating intervention may be preceded by the added intervention of closing off and isolating the well regions with mechanisms capable of accommodating such high pressure applications.

Closing off of a well region for a subsequent high pressure application may be achieved by way of setting a mechanical plug. That is, a plug may be positioned at a downhole location and 'set' to seal off a downhole region adjacent thereto. The plug is configured to accommodate the high pressures associated with perforating or stimulating as noted. Thus, it is generally radially expandable in nature through the application of substantial compressible force. In this manner, slips of the radially expandable plug may be driven into engagement with a casing wall of the well so as to ensure its sufficient anchoring. By the same token, the radial responsiveness of elastomeric portions of the plug may help ensure adequate sealing for the high pressure application to be undertaken.

Unfortunately, the noted compression and overall setting application is generally achieved by way of an explosively powered setting tool that is coupled to the plug. Even setting aside the transport hazards and limited reliability associated with such explosively driven applications, the operator is unable to direct a controlled, monitored, or intelligent setting application when such is explosively driven. Thus, the setting application generally proceeds in an unintelligent manner without readily available data to ensure its effectiveness.

Alternatively, in the case of perforating or stimulating applications, electronics may be used to trigger the application. However, such electronics are relatively unsophisticated and limited to initiating a trigger, for example, for perforating. Thus, the cost of replacement due to heat or shock damage encountered in carrying out the application may be relatively low. To the contrary, substituting explosives with electronics for a setting application involves directing a motor drive unit over the period of the application (e.g. as opposed to merely initiating a perforating trigger). As such, the electronics involved may utilize digital signal processing and other sophisticated capacity, thereby driving up replacement cost where heat and/or shock damage are experienced over the course of the application.

Unfortunately, techniques for mitigating heat and shock damage to sophisticated electronics packaging generally run contrary to one another. In the particular circumstance of plug setting, the setting tool, packaging, and plug may be exposed to about 200 g's or more, not to mention temperatures in excess of 150° C. So, for example, if heat dissipation is addressed through a conventional technique including a heat sink in conjunction with spring compression directed at the electronics, secondary shocks in excess of 200 g's are likely imparted on the electronics. In other words, the heat dissipation technique may have amplified shock directed at the electronics.

Alternatively, where electronics are tightly accommodated through a conventional o-ring or centralizer mounting technique to enhance shock tolerance, thermal contact between the electronics and heat sink, or other thermal dissipating structure, is compromised. Ultimately, due to such counter-intuitive options available for dealing with heat and shock, explosively driven setting is generally utilized in lieu of superior, but costly electronics that would allow for a controlled, monitored, and/or intelligent setting application.

SUMMARY

An electronics package is provided with a housing having a channel therethrough. The channel is configured to accommodate first and second electronics chassis adjacent one another. Each chassis includes an inclined surface for interfacing one another. An activation force mechanism is also disposed in the channel adjacent one of the chassis. The mechanism may be configured for axially directing this chassis toward the other such that radial expansion of the chassis toward the housing takes place via interfacing of the inclined surfaces.

DETAILED DESCRIPTION

Embodiments herein are described with reference to certain shock tolerant heat dissipating electronics packaging types. For example, these embodiments focus on sophisticated electronics packages utilized in conjunction with setting a downhole bridge plug or other type of well isolation mechanism. However, a variety of applications utilized at, or outside of, the oilfield environment may take advantage of the unique combination of shock and heat dissipating features of electronics packaging as detailed herein. Indeed, such packaging may be beneficial wherever electronics are subject to both extreme temperature and shock environments. Regardless, embodiments of the electronics packaging detailed herein include multiple chassis with interfacing inclined surfaces, such that application of an activation force leads to a radial expansion of the chassis toward a housing thereabout. As a result, a near monolithic structure is formed that is substantially enhanced in terms of heat and shock resistance.

Figure 1:
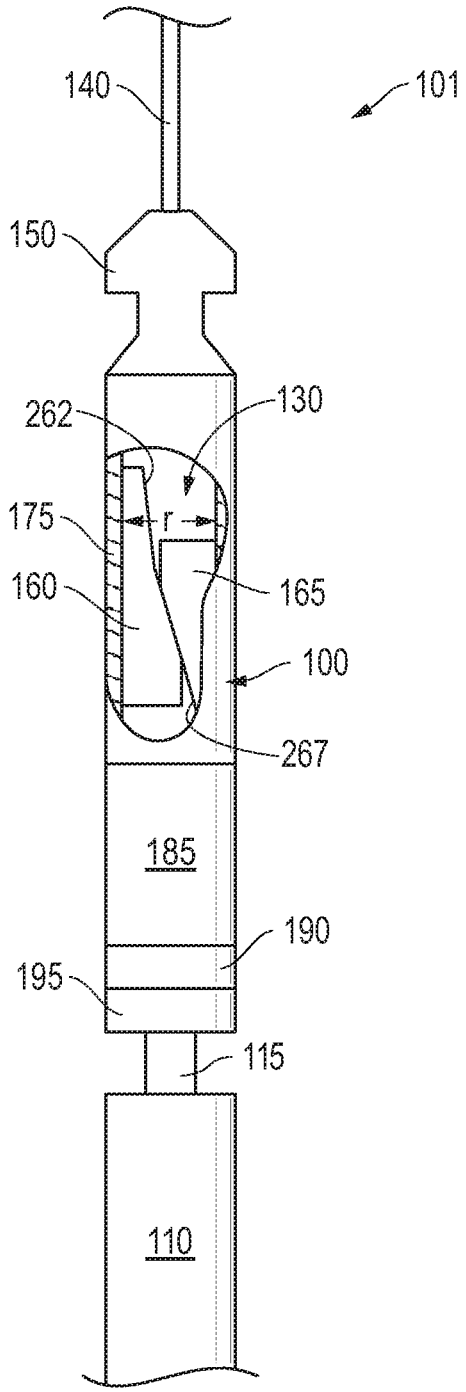
FIG. 1 is a partially sectional view of an embodiment of a shock tolerant heat dissipating electronics package incorporated into a bridge plug setting tool.

Referring now to FIG. 1, a partially sectional view of a shock tolerant heat dissipating electronics package 100 is shown. The package 100 is incorporated into a downhole tool, such as a bridge plug setting tool 101 for placement of a bridge plug 400 at a target location in a well 480 (see FIG. 4). However, embodiments of the package 100 may be advantageously utilized in conjunction with a host of wellbore applications including other high temperature and/or high shock exposure applications. Such applications may include setting of well isolation mechanisms other than bridge plugs, such as mechanical packers. Further, as indicated above, applications outside of the oilfield environment may also take advantage of such electronics packaging embodiments.

In the embodiment of FIG. 1, the package 100 is depicted with a housing 175 defining a channel 130 for accommodating electronic chassis 160, 165. In FIG. 1, these chassis 160, 165 are depicted in a roughly schematic form, each having inclined surfaces 262, 267 oriented toward the interior of the housing 175. Indeed, each chassis 160, 165 takes on an appearance similar to a wedge type door stop. As detailed herein below, the resulting wedging, as axial force is applied to either of the chassis 160, 165, allows for a radial expansion of the chassis 160, 165 relative one another. Thus, from one side of the housing 175, across its radius (r), from chassis 160 to chassis 165, and to the other side of the housing 175, the package 100 takes on the character of a near monolithic structure. Thus, internal movement is virtually eliminated and thermal contact maximized. As a result, heat dissipation and shock tolerance of the chassis 160, 165 are enhanced as also described further below.

Figure 4:
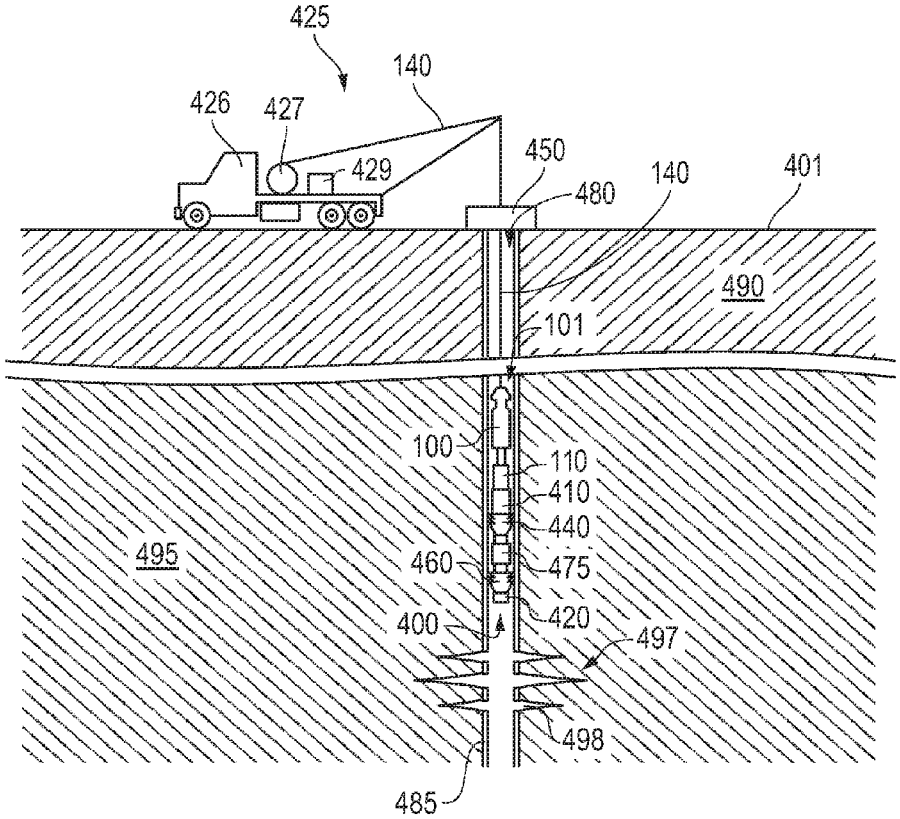
FIG. 4 is an overview of an oilfield with a well accommodating a bridge plug and setting tool employing the electronics package of FIGS. 1, 2, 3A and 3B.

Continuing with reference to FIG. 1, the bridge plug setting tool 101 is also equipped with a power housing 185 as well as sensor 190 and valve 195 housings. These features of the tool 101 may be important in allowing a controlled deployment and setting of the bridge plug 400 as shown in FIG. 4. The power housing 185 in particular, may accommodate an axial piston pump driven by a sophisticated motor. In one embodiment, a brushless DC motor is utilized. As such, the motor drive electronics accommodated at the chassis 160, 165, may include a digital signal processor and other fairly sophisticated components for driving a controlled setting application.

The bridge plug setting tool 101 is equipped with a housing sleeve 110 which may be hydraulically driven by the above noted pump via an extension 115. Thus, as detailed below with added reference to FIG. 4, a bridge plug 400 coupled to the sleeve 110 may be compressed and radially set at a location in a well 480 for isolation thereat. Further, the tool 101 is shown with its head 150 coupled to a line 140 for deployment into the well 480. In one embodiment, this line 140 may be a conventional wireline cable to allow for powering of the setting application as well as for real-time telemetry over electronics of the line 140. Thus, parameters of the setting application may be changed in real-time based on data obtained during the setting application (e.g. from the sensor 190). That is to say, electronics of the package 100 may be utilized to alter the setting application in process.

In an embodiment, the line 140 may be a slickline or other non-powered line. In such an embodiment, powering of the application may be achieved by way of a suitably sized downhole power source (e.g. a lithium-based battery) coupled to the tool 101. Nevertheless, downhole conditions and other data relating to the application may be recorded and stored by electronics of the package 100. Thus, subsequent analysis at surface may be available to help determine effectiveness and other details of the application.

Figure 2:
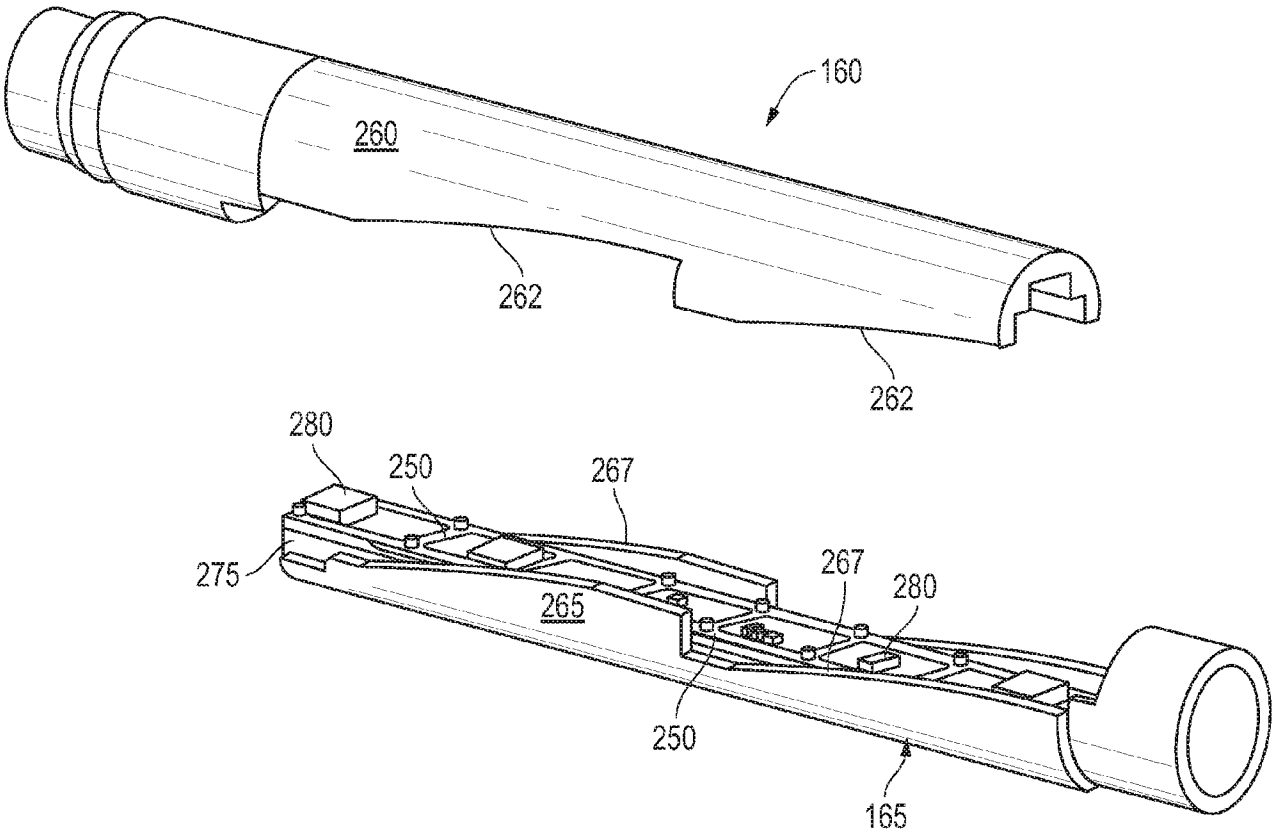
FIG. 2 is an exploded view of adjacent chassis of the electronics package of FIG. 1.

Referring now to FIG. 2, an exploded view of the adjacent chassis 160, 165 of the electronics package 100 of FIG. 1 is shown. In this view, a less schematic, and more realistic depiction of the chassis 160, 165 is provided. Nevertheless, the inclined surfaces 262, 267 of each are apparent. More specifically, each chassis 160, 165 includes a platform 260, 265 defined by the respective surfaces 262, 267 for interfacing one another. In fact, in the embodiment shown, the inclined surfaces 262, 267 are staggered and repeating, taking the appearance of inclined stair steps. Indeed, while each platform 260, 265 is shown with two such staggered and repeating surfaces 262, 267, any practical number, say 1-5 or more, may be employed. The number of such inclines may be selected based on factors such as, but not limited to, the overall length of the package 100 of FIG. 1 and the angles utilized for the surfaces 262, 267.

Continuing with reference to FIG. 2, each platform 260, 265 serves as a structural substrate to which an electronics board 275 may be secured. In the embodiment shown, the board 275 may be a conventional printed circuit board with electronics 280 electronically and physically secured thereto. Further, the board 275 may be mounted in place through the aid of a cover plate 250. Thus, sophisticated electronics are provided at each chassis 160, 165 in much the same manner as other conventional electronics packaging. However, as detailed below, the shape, manner of interfacing, and overall configuration of the chassis 160, 165 enhance shock tolerance and heat dissipation in a unique manner for electronics packaging.

Figure 3A:
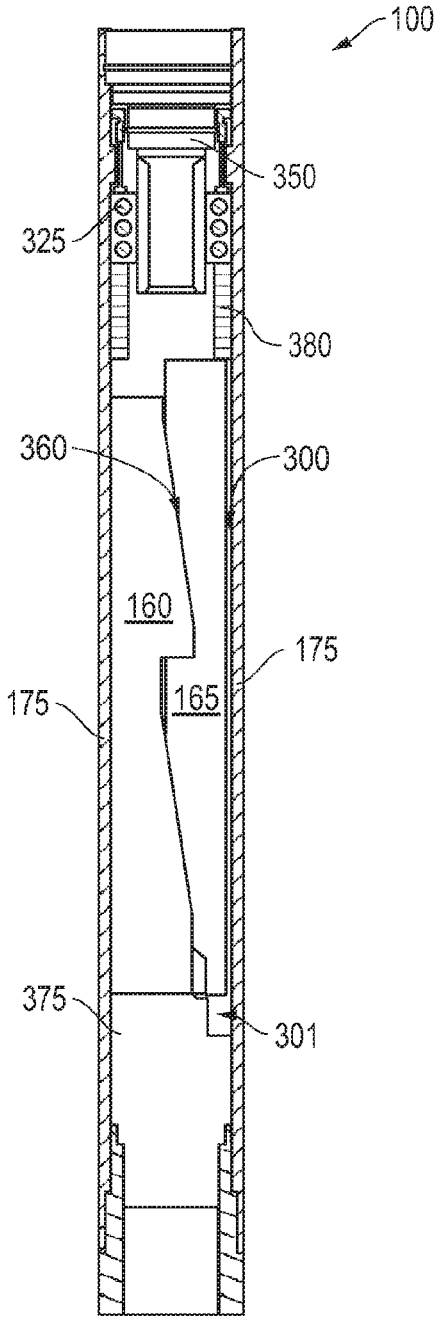
FIG. 3A is a side cross sectional view of the electronics package of FIG. 1 with the adjacent chassis of FIG. 2 in an unexpanded pre-set position.
Figure 3B:
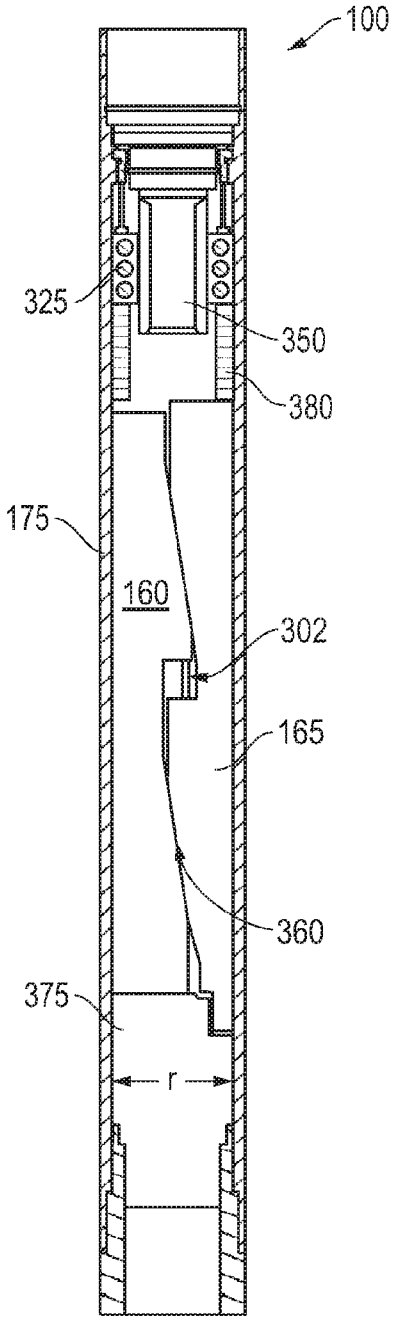
FIG. 3B is a side cross sectional view of the package of FIG. 3A with the chassis in a radially expanded set position.

Referring now to FIGS. 3A and 3B, side cross sectional views of the electronics package 100 of FIG. 1 are shown. More specifically, FIG. 3A reveals the adjacent chassis 160, 165 of FIG. 2 in an unexpanded pre-set position whereas FIG. 3B reveals the chassis 160, 165 in a radially expanded set position. That is to say, in FIG. 3A, the chassis 160, 165 are disposed in the housing 175 with a degree of movement or play (note the available space 300 present between one of the chassis 165 and the housing 175). However, in FIG. 3B, an axial force has been applied to at least one of the chassis 160, 165 such that sliding along the interface 360 is induced. Thus, the available space 300 is eliminated and a substantially monolithic structure of housing 175 and chassis 160, 165 is formed.

In the particular embodiment of FIGS. 3A and 3B, axial force is imparted on the chassis 160, 165 through the combination of a screw 350 at one end and a structural stop 375 at the other. More specifically, a screw 350, may be threadably disposed in the housing 175 adjacent one of the chassis 165 for exerting an axial force thereon (downwardly in the depictions of FIGS. 3A and 3B). By the same token, a stop 375, structurally integral with the housing 175 may be located immediately adjacent the other chassis 160, opposite the screw 350. Indeed, this chassis 160 may even be immobilized by securing to the stop 375 or other structural portion of the housing 175.

As the screw 350 is turned to threadably apply axial downward force on the adjacent chassis 165, this chassis 165 slides along the interface 360. In one embodiment, skids, perhaps of beryllium copper, are provided to each chassis 160, 165 for interfacing and stably aiding such sliding. Once more, an end of the sliding chassis 165 may enter a stop space 301 adjacent the stop 375. More importantly, however, this movement eliminates the available space 300 adjacent the chassis 165 as noted above. Thus, the entire interior radius (r) of the housing 175 is occupied by chassis structure, forming a substantially monolithic package 100. As such, the possibility of secondary shock induction is largely eliminated, while at the same time near complete thermal contact between the chassis 160, 165 and housing 175.

In the embodiment shown, the angle of interface 360, via surfaces 262, 267 (see FIG. 2), exceeds about 45°. As such, the amount of radial force by the chassis 160, 165 toward the interior wall of the housing 175, exponentially exceeds the amount of axial force applied by the screw 350. For example, no more than about 2,000 lbs. of axial force may translate to more than about 15,000 lbs. of radial force in such an embodiment. Thus, the chassis 160, 165 are now firmly immobilized by the indicated tightening of the screw 350.

In the embodiment of FIGS. 3A and 3B, the axial force of the screw 350 is translated through a spring 325 and screw sleeve 380 in reaching the noted chassis 165. In this manner, the spring 325 may allow for dimensional changes in the housing and/or chassis 160, 165. So, for example, where exposure to extreme temperatures is prone to induce such dimensional changes, the axial force imparted through the screw 350 may remain substantially unaffected. Indeed, in one embodiment where temperatures well in excess of 100° C. are to be encountered, the platforms 260, 265 of the chassis 160, 165 may be aluminum-based whereas the housing 175 is of a stainless steel composition. Thus, the presence of the intervening spring 325 may help to ensure a more consistent axial force, in spite of likely slight dimensional changes in the chassis 160, 165. Of course in other embodiments, an intervening spring 325 may not be utilized. Indeed, an axial force inducing mechanisms other than a screw 350 may also be employed.

Referring now to FIG. 4, an overview of an oilfield 401 is depicted accommodating a well 480. The well 480 in turn accommodates a bridge plug 400 and the setting tool 101 detailed above, with the electronics package 100 of FIGS. 1, 2, 3A and 3B.

The well 480 traverses various formation layers 490, 495 and may expose the electronics package 100 to a variety of extreme pressures and temperatures as alluded to above. The well 480 is also defined by a casing 485 that is configured for sealing and anchored engagement with the plug 400 upon a high shock inducing setting application as also described above (and further below). In the embodiment shown, the plug 400 is equipped with upper 440 and lower 460 slips to achieve anchored engagement with the casing 485 upon the setting. Similarly, a generally elastomeric, sealing element 475 is disposed between the slips 440, 460 to provide sealing of the plug 400 relative the casing 485 by way of the setting application.

The assembly of the setting tool 101 and plug 400 also includes a platform 420 at its downhole end. This platform 420 is coupled internally to the extension 115 of the tool 101 (see FIG. 1). Thus, the plug 400 is compressed between this platform 420 and the housing sleeve 110, as this sleeve 110 is forced against a plug sleeve 410 of the plug 400. In this way, the setting application ultimately radially expands plug components into place once the plug 400 is positioned in a targeted location.

In the embodiment shown, the targeted location for placement and setting of the plug 400 is immediately uphole of a production region 497 with defined perforations 498. So, for example, the plug 400 may be utilized to isolate the region 497 for subsequent high pressure perforating or stimulating applications in other regions of the well 480.

Continuing with reference to FIG. 4, the wireline delivery of the assembly means that even though a relatively high powered setting application is undertaken, it may be done so with relatively small mobile surface equipment 425. Indeed, the entire assembly traverses the well head 550 and is tethered to a spool 427 of a wireline truck 426 without any other substantial deployment equipment requirements. In the embodiment shown, a control unit 429 for directing the deployment and setting is also shown. The control unit 429 may ultimately be electrically coupled to the electronics packaging 100 so as to monitor and intelligently control the setting of the plug 400. That is to say, the unit 429 may initiate setting and also modify the application in real time, depending on monitored pressure and other application data as described above.

Figure 5A:
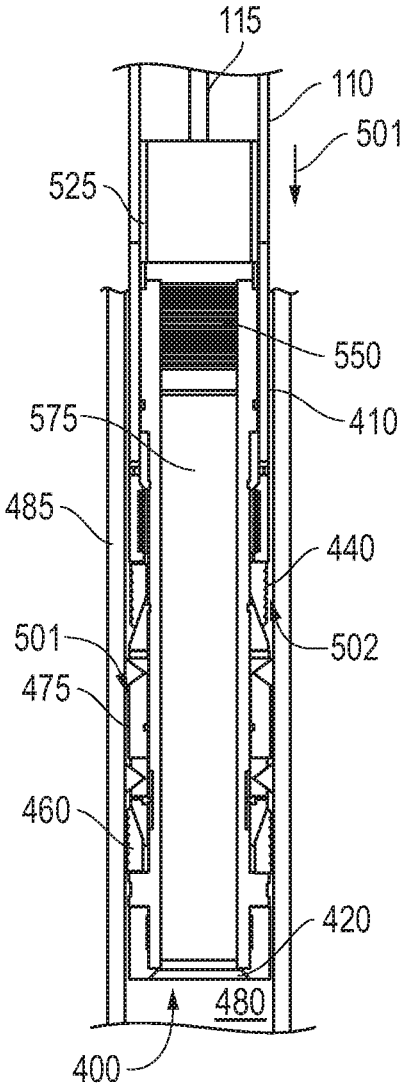
FIG. 5A is an enlarged side view of the bridge plug and setting tool of FIG. 4 positioned at a targeted isolation location in the well.
Figure 5B:
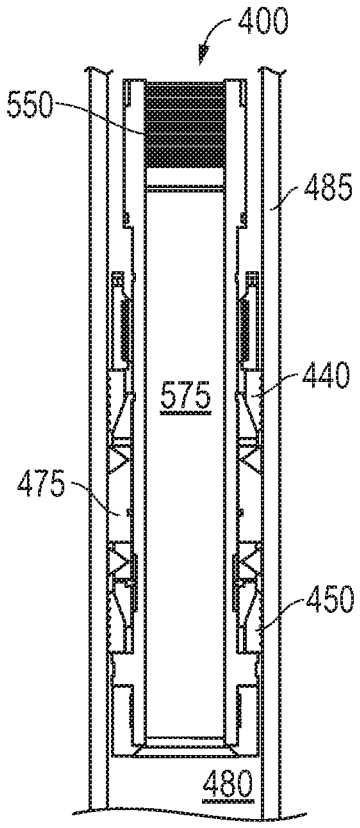
FIG. 5B is an enlarged side view of the bridge plug of FIG. 5A upon setting thereof at the targeted isolation location.

Referring now to FIGS. 5A and 5B, enlarged side views of the bridge plug 400 and lower portion of the setting tool 101 of FIG. 4 are depicted positioned at the noted targeted location in the well 480 for isolation. More specifically, FIG. 5A depicts the initiation of the setting application as the plug 400 is compressed between the housing sleeve 110 and the platform 420. FIG. 5A depicts the plug 400 following setting with the housing sleeve 110 removed and the slips 440, 460 and seal 475 in a complete radially expanded state.

Continuing with reference to FIGS. 5A and 5B mechanics of the noted compression and setting are described. In the embodiment shown, the platform 420 is ultimately physically coupled to the extension 115 by way of a central mandrel 575, plug head 550, and tool coupling 525. Yet, at the same time, the platform 420 serves as a backstop to downward movement of non-central plug components such as the slips 440, 460, seal 475, sleeve 410, etc. Thus, the depicted movement 501 of the housing sleeve 110 tends to compress plug components therebetween until the plug 400 is set against the casing 485.

With specific reference to FIG. 5A, the plug 400 is compressed upon initial setting of lower slip rings 460 by the downward movement 501 of the housing sleeve 110. That is, as the force of the downward movement 501 is translated through the plug sleeve 410 and other plug components, the radially expandable component closest the platform 420 begins its expansion. Thus, in FIG. 5A, teeth of the lower slips 460 are shown engaging and biting into the casing 485 defining the well 480. As a result, anchoring of the plug 400 has begun. At the same time, however, the seal 475 and upper slips 440 have yet to be substantially compressed. Therefore, interfacing spaces 501, 502 remain between these components and the casing 485.

Referring to FIG. 5B, however, as the housing sleeve 110 continues to move in the downward direction, the indicated spaces 501, 502 disappear. This disappearance takes place as the seal 475 engages the casing 485 and the upper slips 440 radially expand and bitingly set into the casing 485. Thus, the anchoring of the plug 400 and the sealing isolation of the well 480 takes hold. It is worth noting that in compressing the plug 400 in this manner, its general location within the well 480 is unaffected. That is to say, the downward movement 501 of the sleeve 110 acts against the platform 420 to achieve the noted compression as opposed to having any significant affect on the plug 400 depth in the well 480.

Ultimately, as the sequential setting of plug components is completed a fully anchored plug 400 and sealingly isolated well 480 are provided at the targeted location. The application is completed with the breaking of a tension stud within the plug mandrel 575. This may induce a large shock of over about 200 g's and lead to a release of the housing sleeve 110 of FIG. 5A. Indeed, as depicted in FIG. 5B, the setting tool 101 of FIG. 1 is completely withdrawn from the well 480 with a pull out of the engaged housing 110 and plug 410 sleeves along with the engaged extension 115 and tool coupling 525. However, in other embodiments, the particular interfacing components of the tool 101 and plug 400 which are left or withdrawn may vary. Further, a follow-on pressure-based application such as bore stimulation may subsequently proceed.

Regardless, a setting of a plug 400 has now been fully completed in a manner driven by relatively sophisticated electronics without undue concern over shock damage to the electronics packaging 100. In fact, due to the substantially monolithic nature of this packaging 100, exposure to secondary shock is virtually eliminated (see FIG. 1).

Figure 6A:
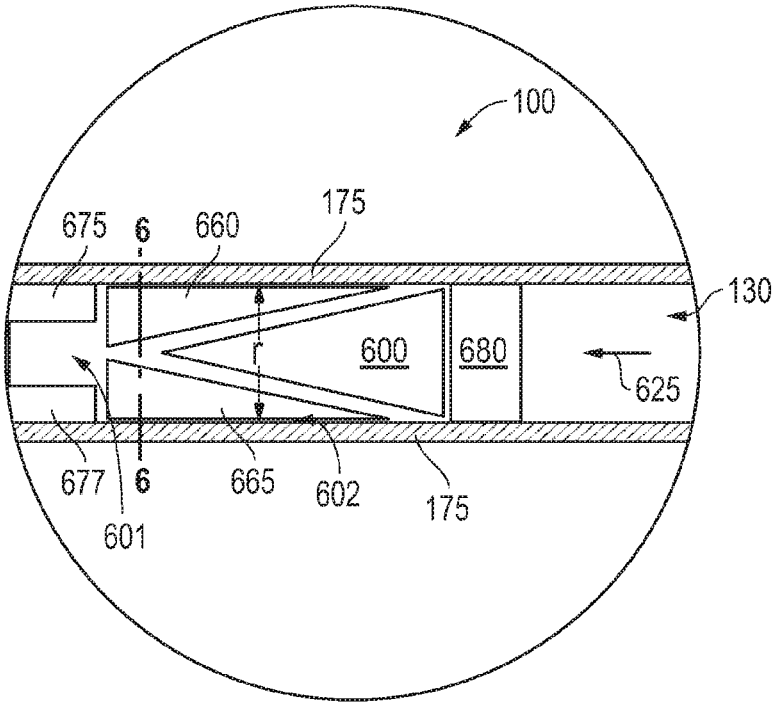
FIG. 6A is a schematic view of an alternate embodiment of a shock tolerant heat dissipating electronics package with chassis in an unexpanded pre-set position.
Figure 6B:
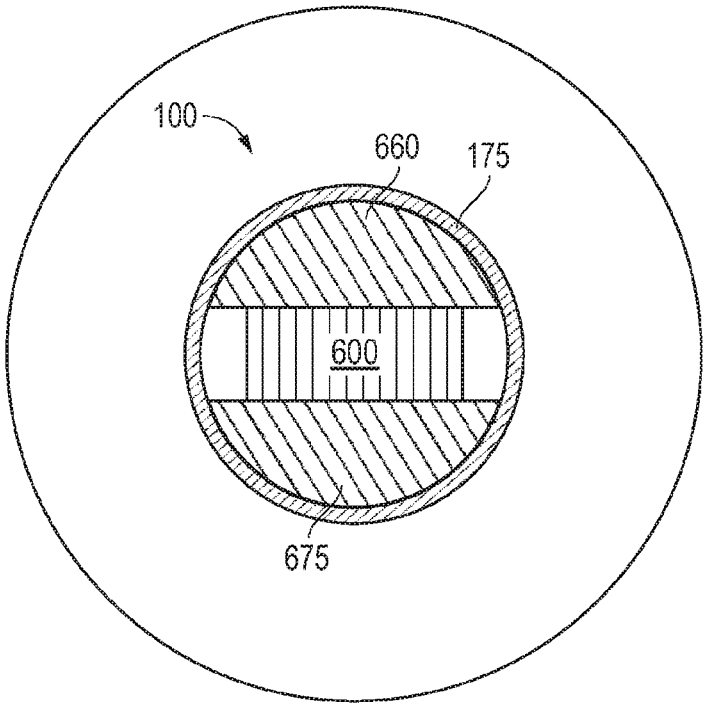
FIG. 6B is a cross-sectional view taken from 6-6 of FIG. 6A with the chassis in a radially expanded set position.

Referring now to FIGS. 6A and 6B, schematic views of an alternate embodiment of a shock tolerant heat dissipating electronics package 100 are shown. In such an embodiment, more than two chassis 600, 660, 665 are utilized for wedgingly interfacing to eventually form a shock and heat resistant near-monolithic electronics packaging structure. More specifically, FIG. 6A shows the package 100 with three chassis 600, 660, 665 in an unexpanded pre-set position relative to one another. FIG. 6B on the other hand is a cross-sectional view taken of these chassis 600, 660, 665 in a radially expanded set position (taken from 6-6 of FIG. 6A).

In the unexpanded pre-set position of FIG. 6A, the chassis 600, 660, 665 are shown with some degree of play. For example, note the unoccupied free space 602 between one of the chassis 665 and the housing 175. Nevertheless, a force inducing mechanism 680 (such as a screw or the like) may be driven in a direction 625 through the channel 130 of the housing 175 so as to wedgingly interface a chassis 600 into engagement with the others 660, 665. As shown in FIG. 6A, structural stops 675, 677 are provided to prevent movement of these other chassis 660, 665 in the direction 625 in response to the force inducing mechanism 680. Indeed, in the embodiment shown, the driven chassis 600 may even extend to a degree into a space 601 beyond the other chassis 660, 665 and stops 675, 677 if need be.

Ultimately, the free space 602 is eliminated and the near-monolithic packaging structure of FIG. 6B is achieved in a manner similar to that detailed hereinabove with respect to FIGS. 3A and 3B. The embodiment of FIGS. 3A and 3B focus on the utilization of two chassis 160, 165 and three 600, 660, 665 are shown in FIGS. 6A and 6B. However, any practical number of two or more chassis may be employed so long as wedgingly interfacing surfaces between the chassis are accommodated by the design. Indeed, an embodiment utilizing four interlocking chassis may be utilized. Further, as the number of chassis utilized is increased, the chassis may be configured such that one set of finger-like chassis extending from a common base is directed for interlocking engagement with another set of finger-like chassis from another common base. So long as angled interfacing is provided for, a force inducing mechanism may be utilized to axially drive the chassis sets toward one another until a near-monolithic packaging structure is attained, thereby substantially enhancing temperature and shock resistance.

Embodiments described hereinabove utilize techniques for mitigating both heat and shock damage to sophisticated electronics packaging. Thus, such comparatively higher cost packaging may be reliably utilized even upon repeated exposure to shock in excess of 200 g's and temperatures in excess of 100° C. in downhole operations. Such packaging is configured in a manner that avoids significant secondary shock through compression springs disposed in the load path while also avoiding o-ring or centralizer mounting techniques that tend to adversely affect heat dissipation.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. An electronics package comprising:

a housing defining a channel therethrough;

a first electronics chassis disposed in the channel with a first inclined surface at an end thereof;

a second electronics chassis disposed in the channel adjacent said first electronics chassis and with a second inclined surface at another end thereof; and a screw operatively disposed through the housing and configured to apply axial downward force to the first electronics chassis adjacent thereto; and a stop structurally integral with the housing and adjacent the second electronics chassis.

2. The electronics package of claim 1 wherein said second chassis is immobilized relative said housing by one of the adjacent stop and structural adherence to said housing.

3. The electronics package of claim 1 wherein the inclined surfaces are of a staggered and repeating configuration.

4. The electronics package of claim 1 wherein at least one of said chassis comprises:

a structural platform; and an electronics board mounted to said platform.

5. The electronics package of claim 4 wherein said electronics board accommodates motor drive electronics for directing a motor of a downhole application tool.

6. The electronics package of claim 5 wherein the motor drive electronics include a digital signal processor.

7. The electronics package of claim 1 further comprising at least one more chassis disposed in the channel with at least one more inclined surface to enhance the radial expansion via interfacing with another of the inclined surfaces.

8. A downhole assembly for disposal in a well, the assembly comprising:

a well isolation mechanism;

a setting tool coupled to said isolation mechanism for anchoring and sealing thereof at a location in the well; and a housing incorporated into said tool and accommodating multiple electronics chassis for driving a motor of said tool, the chassis equipped with inclined surfaces oriented for interfacing one another and radially expanding for substantial immobilization thereof upon exposure to an axial force driving the interfacing, wherein the axial force is imparted by a screw disposed through the housing adjacent one of the electronics chassis and a stop structurally integral with the housing and adjacent the other chassis.

9. The downhole assembly of claim 8 wherein said isolation mechanism is one of a bridge plug and a mechanical packer.

10. The downhole assembly of claim 9 wherein said tool is hydraulically driven.

11. The downhole assembly of claim 10 wherein the motor is a brushless dc motor, said tool comprising an axial piston pump.

12. A method comprising:

providing a housing accommodating a first electronics chassis with a first inclined surface;

positioning a second electronics chassis with a second inclined surface in the housing oriented for interfacing of the surfaces; and imparting an axial force on the second chassis for radial expansion of the chassis in the housing to form an electronics package, wherein the axial force is imparted by a screw disposed through the housing adjacent one of the electronics chassis and a stop structurally integral with the housing and adjacent the other chassis.

13. The method of claim 12 wherein the axial force is less than about 2,000 lbs. and the radial expansion imparts more than about 15,000 lbs. of radial force toward an inner wall of the housing.

14. The method of claim 12 further comprising:

deploying the housing into a well over a line as part of downhole tool coupled to a well isolation mechanism; and performing a wellbore application at a target location in the well.

* * * * *